United States Patent [19]

Pousár

[11] Patent Number: 4,691,955

[45] Date of Patent: Sep. 8, 1987

[54] RIGID PLACE MAT

[75] Inventor: Kurt Pousár, Helsinki, Finland

[73] Assignee: Oy Wärtsilä Ab, Helsinki, Finland

[21] Appl. No.: 875,629

[22] Filed: Jun. 18, 1986

[30] Foreign Application Priority Data

Jun. 25, 1985 [FI] Finland ..... 852498

[51] Int. Cl.[4] ..... B65D 73/00

[52] U.S. Cl. ..... 294/142; 294/143; 294/144; 294/172; D7/37

[58] Field of Search ..... 294/142, 143, 144, 172, 294/169, 141; 206/457, 557, 462, 461; 224/906; D3/42; 428/12; D7/31, 34, 37, 38

[56] References Cited

U.S. PATENT DOCUMENTS 2,608,842 9/1952 Greene et al. ..... 294/144

4,489,971 12/1984 Martinez, Sr. ..... 294/172

*Primary Examiner*—James B. Marbert

*Attorney, Agent, or Firm*—Dellett, Smith-Hill and Bedell

[57] ABSTRACT

The invention relates to a rigid place mat, which is used as an individual tray or support for dishes or drinking vessels on a table or in the lap. The place mat comprises a flexible cloth, in which there is formed by means of sewing, gluing or some corresponding method a pouch-like case. Into this case there is arranged a rigid plate as a stiffener of the place mat.

14 Claims, 7 Drawing Figures

RIGID PLACE MAT

Figure 1:
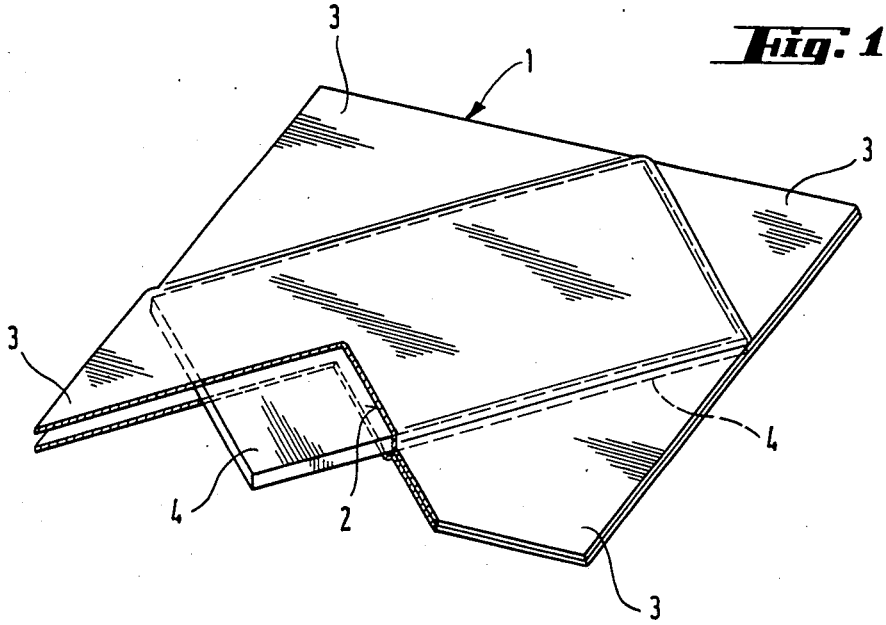

The invention relates to a rigid place mat according to the preamble of claim 1.

There are previously known small table covers or place mats, which are used at the dining or coffee table in front of each person. The purpose of these place mats is to protect the table and a bigger tablecloth, and to act as a decoration of the table setting. Such place mats are usually produced of cloth, plastic, bast, paper or a similar flexible and thin material. The drawback of such place mats is that they are not transportable to another place by means of carrying or lifting, when they are covered by dishes, and even transport by means of pulling along the table surface is difficult.

There are previously also known trays, which may be used as eating or drinking support on the table or in a person's lap. In order to get a rigid tray, it is usually produced of wood, plastic, sheet metal or some other hard material. Such trays are generally also meant for usual everyday usage, and they are badly suited for a formal table setting.

In occasions, where there are more eaters and coffee drinkers or the like than space is available at the dining or coffee table, the present persons frequently have problems in handling the dishes in connection with the meal. At the meal place (a chair, stair, stump etc.) one has to resort to most different solutions in placing the dishes within the reach of the hands. There is also known to use individual assistance tables at the meal place, which tables in order to facilitate intermediary storage comprise foldable legs or the like. A drawback of assistance tables with legs is that, despite the foldable feature, they demand much space. Due to their different leg constructions, they are quite expensive. When they comprise four legs, they do not suit very well for usage in uneven terrain (at the cabin, in a boat, etc). When they comprise three legs, they are too unstable, and they do not suit very well as trays or as transport supports of dishes.

The object of the invention is to create a rigid place mat which eliminates the drawbacks of the known solutions, and to produce a completely new, better functioning, more versitile and more formal and hygienic place mat, which still is simple and easy to accomplish, and inexpensive to produce.

A rigid place mat according to the invention is formed by a flexible cloth and a rigid plate, which is. arranged inside a pouchlike case formed in the cloth. By this means there is formed a place mat, which may be used as a support for dishes and drinking vessels both on the table and also in the lap, because it is, due to its rigid state, carryable and it may easily be transported although it is covered by dishes. Each guest takes from the serving table a rigid support cloth of his own, collects on this the food and drinks he wants and seeks himself a seat somewhere. In the lap, the support acts as a table. The punchlike case may be formed in the cloth by means of sewing, gluing or some similar method, and at least one of the sides of the case is to be opened so that the rigid plate may be put in it. Outside the pouchlike case remain parts of the cloth, which here are called hems. These hems may be folded and spread out in different ways in order to bring about varying settings. Variableness and decorativeness may also be accomplished so, that the covering cloth or cover pouch may be of different colours and patternings on different sides. Depending on the selection of cloth material, the rigid place mat consisting of the same rigid plate may be used both for everyday settings and for formal settings to create a different atmosphere. The hems of the covering cloth may also be used to protect the tablecloth and the table, when the rigid place mat is used as a support for dishes and drinking vessels on the table, and to protect clothing, especially when it is used as a support in the lap. Folded in different manners, the hems will protect either more or less. By means of a rigid place mat according to the invention, also the table napkin will easily be substituted. The hems of the covering cloth may also be used to protect the food and the dishes on the place mat and to keep the food warm, by means of turning the hems over the dishes and the food placed upon the place mat. The so-called cover pouch acts also, provided with a stiffener or without that, as a bottom cloth on an ordinary table. A smaller version of the rigid place mat, which is to be held by one hand, may be necessary in situations, where coffee or the like is taken standing.

The rigid plate, which is to be arranged inside the pouchlike case, is generally formed like the pouchlike case and somewhat smaller than the case, so that the plate may easily be put into the case or taken therefrom. By this means, the cloth is easily changeable and washable, so the place mat is also hygienic. The plate and the pouchlike case are preferably shaped as rectangles, and the plate may be produced of some suitable rigid material, for example ceramics, wood, plastic or metal. At the ends of the rigid plate there may be formed groove-like depressions or handle openings. Into said handles different racks for the dishes and drinking vessels may be fastened, and the eating will thus be easier, when for example a drinking glass stays stable on its place. The rigid plate of a rigid place mat is stored for example by hanging up a whole cluster of 10–20 objects on the wall of the kitchen or inside the door of a cupboard. The rigid piece does not have to be thicker than 2–3 mm (independent of raw material), in other words 20 objects have altogether a thickness of about 50 mm.

A rigid place mat may be used, except for example in home parties where there is not space for all the people at the dining table, also in connection with eating at the working place, at hotels and restaurants, at hospitals, or schools, so as to offer these institutions an unexpensive combination of serving and eating support, which demands little space and has a changeable appearance according to the situation.

Figure 2:
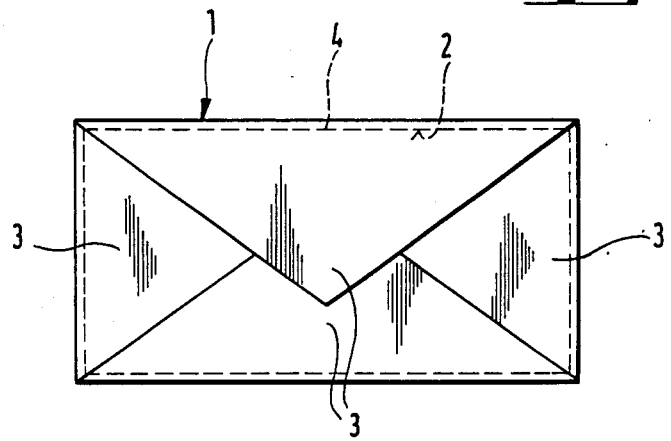
Figure 3:
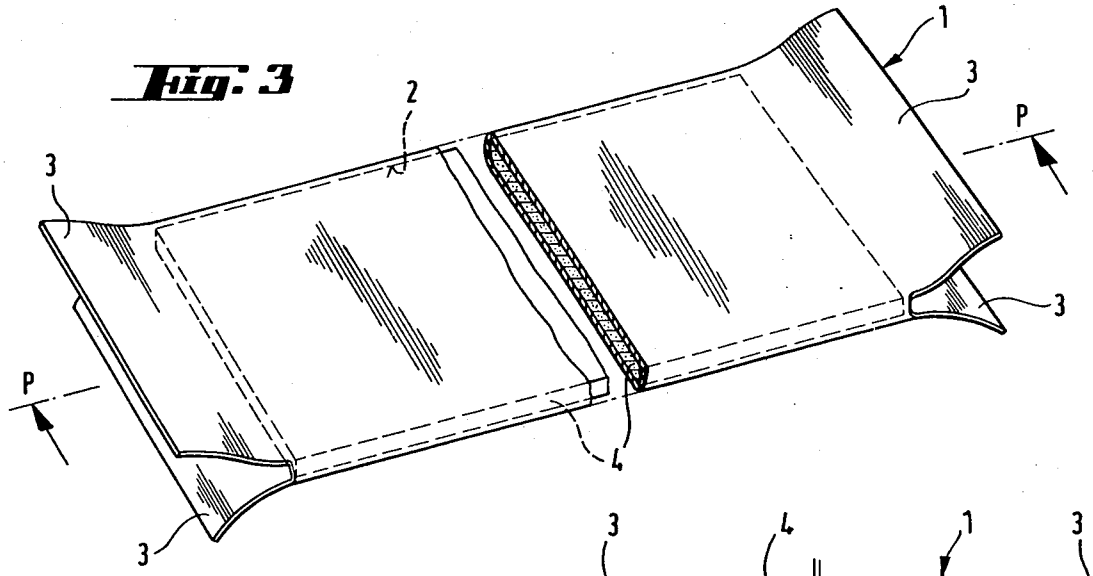
Figure 4:
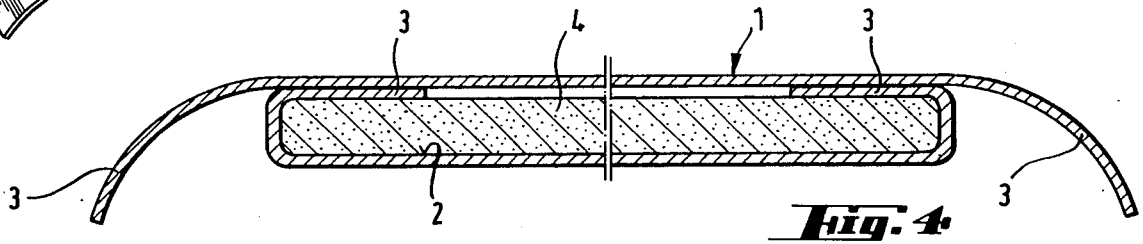
Figure 5:
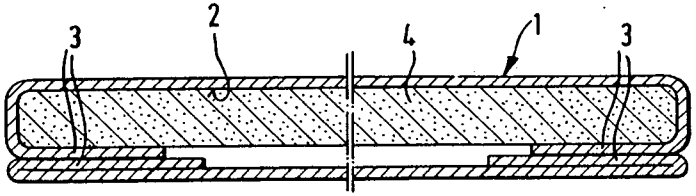
Figure 6:
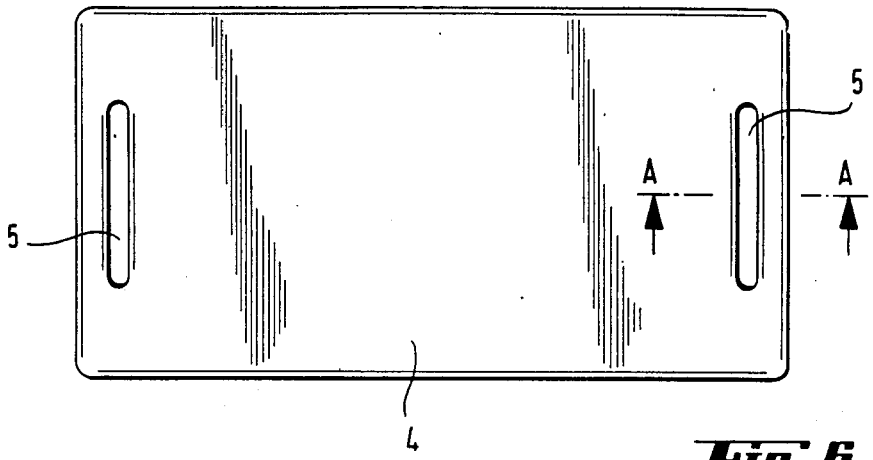
Figure 7:
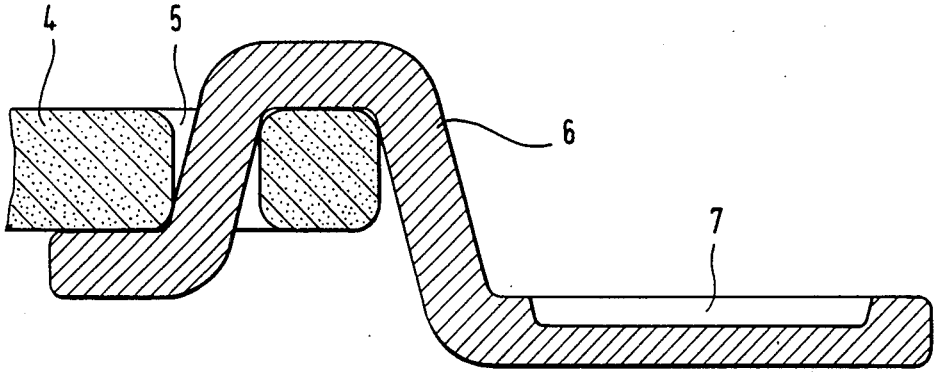

The invention is now described more accurately by reference to the accompanying drawing, in which FIG. 1 is a perspective view of an embodiment of a rigid place mat according to the invention, in which the hems of the cloth are spread out, FIG. 2 is a top view of a rigid place mat according to FIG. 1, in a folded embodiment, FIG. 3 is a perspective view of another embodiment of the invention, in which the hems of the cloth are spread out, FIG. 4 is a sectional view in the plane P—P of a rigid place mat according to FIG. 3, FIG. 5 is a sectional view in the plane P—P of a rigid place mat according to FIG. 3, in another folded embodiment, FIG. 6 is a top view of a rigid plate comprising groove-like handles, and FIG. 7 is a side sectional view in the plane A—A of a rigid plate according to FIG. 6 and a schematical view of a rack arranged in the groove-like handle.

According to FIGS. 1 and 3, a rigid place mat comprises a cloth 1, which preferably is produced of fabric, plasticized fabric or paper, plastic, or some corresponding preferably washable and flexible material. In the cloth 1, preferably in the middle part thereof, there is formed by means of sewing, gluing or some corresponding method a pouchlike case 2, which can be opened at least along one of its sides, so that a rigid plate 4 may be arranged inside it. The plate 4 is easy to take out from the pouchlike case 2, so the cloth 1 may easily be changed to a new one and washed. Those parts of the cloth, which remain outside the pouchlike case 2 and the rigid plate 4 inside that, i.e. the hems 3, may for example as rectangles, triangles or semicircles. In FIG. 1, the hems 3 extending outside the pouchlike case of the rigid place mat are formed as triangles. In FIG. 3, said hems 3 are formed as rectangles. One purpose of said hems 3 is to protect the table and tablecloth when the rigid place mat is used as an eating and drinking support on the table, and to protect the clothes when the rigid place mat is used as a support in the lap.

In FIGS. 1–5 there as shown some folding possibilities of said hems 3. In FIGS. 1 and 3, the hems 3 are spread out. In FIG. 2, the hems 3 are folded together upon the rigid plate 4. In FIG. 4, the lower hems 3 of the cloth 1 are folded upon the rigid plate 4 inside the pouchlike case 2, and the upper hams 3 hang freely. The thickness of the cloth is considerable overstated in the figure due to clarity reasons. In FIG. 5, the hems 3 are folded inside the pouchlike cse 2. Folded in different manners, the hems 3 protect the table, the tablecloth and cloths more or less, according to wants. The hems 3 may also protect the food on the place mat, and help to keep the food warm. A third purpose of said hems 3 is to look decorative and to render it possible to get variable settings suited for different situations. Also for this purpose, each side of cloth 1 may be of different colours and patternings. In FIGS. 6 and 7, there is shown a rigid plate 4 and the groove-like handles 5 at its edges. Different racks 6 may be fastened at said handles. In FIG. 7, there is schematically shown an embodiment of such a rack, in the low depression 7 of which rack there may be placed for example drinking vessels. The rigid plate 4, which preferably is formed as a rectangle, may preferably be produced of ceramics, wood, plastic or some other corresponding suitable rigid material.

FIGS. 1 and 4 show two preferred embodiments of a rigid place mat according to the invention in a situation when the rigid place mat is used as a support in the lap.

The invention is not limited to the described embodiments, but several modifications of the invention are feasible within the scope of the attached claims.

I claim:

1. A rigid place mat, which can be used as an individual tray or support for dishes or drinking vessels on a table or in the lap, comprising a flexible sheet-form member in which there is formed a pouch-like case, and a rigid plate arranged in the pouch-like case as a stiffener.

2. A rigid place mat according to claim 1, in which said cloth sheet-form member extends outside the pouchlike case so, that there are formed hems which protect the table and the clothes.

3. A rigid place mat according to claim 2, in which said hems preferably are formed as rectangles, triangles or semicircles.

4. A rigid place mat according to claim 1, in which the sheet-form member is produced of a washable and flexible material which follows the surfaces of the rigid plate, preferably of fabric, plasticized fabric or paper, plastic or the like.

5. A rigid place mat according to claim 1, in which said sheet-form member has a different colour or patterning on each side.

6. A rigid place mat according to claim 1, in which the pouchlike case may be opened at least at one edge, in order to put the rigid plate into it or to draw it out.

7. A rigid place mat according to claim 1, in which the rigid plate is formed rectangular.

8. A rigid place mat according to claim 1, in which the rigid plate comprises groove-like handle openings or depressions.

9. A rigid place mat according to claim 8, in which the groove-like handle opening of the rigid plate is so formed, that therein may be placed a rack for dishes or drinking vessels.

10. A rigid place mat according to claim 1, wherein the flexible sheet-form member is made of cloth.

11. A rigid place mat according to claim 1, wherein the pouch-like case is formed by sewing.

12. A rigid place mat according to claim 1, wherein the pouch-like case is formed by gluing.

13. A rigid place mat according to claim 1, wherein the rigid plate is made of a material selected from the group consisting of ceramics, wood and plastic.

14. A rigid place mat according to claim 1, wherein the rigid plate is essentially flat and is bounded by a periphery that is of substantially the same size and shape as the periphery of the pouch-like case.

* * * * *